US006341851B1

(12) United States Patent
Takayama et al.

(10) Patent No.: US 6,341,851 B1
(45) Date of Patent: Jan. 29, 2002

(54) INK JET RECORDING APPARATUS INCLUDING A PRESSURE CHAMBER AND PRESSURE APPLYING MEANS

(75) Inventors: Ryoichi Takayama, Suita; Yuji Takashima, Nishinomiya; Eiichiro Tanaka, Kishiwada; Koji Ikeda, Katano; Osamu Kawasaki, Kyotanabe; Masayoshi Miura, Kawasaki, all of (JP)

(73) Assignee: Matsushita Electric Industrial Company, Ltd., Osaka (JP)

( * ) Notice: Subject to any disclaimer, the term of this patent is extended or adjusted under 35 U.S.C. 154(b) by 0 days.

(21) Appl. No.: 09/487,221

(22) Filed: Jan. 19, 2000

Related U.S. Application Data

(63) Continuation of application No. 08/960,342, filed on Oct. 29, 1997.

(30) Foreign Application Priority Data

Oct. 29, 1996 (JP) ..... 8-286479

(51) Int. Cl.[7] ..... B41J 2/045
(52) U.S. Cl. ..... 347/70; 347/55
(58) Field of Search ..... 347/68, 70, 71, 347/72, 55

(56) References Cited

U.S. PATENT DOCUMENTS

| | | | | |
|---|---|---|---|---|
| 4,546,362 A | * | 10/1985 | Koto | 347/70 |
| 4,672,398 A | | 6/1987 | Kuwabara et al. | |
| 5,028,936 A | | 7/1991 | Bartky et al. | |
| 5,221,934 A | * | 6/1993 | Long | 247/55 |
| 5,271,957 A | | 12/1993 | Wernberg et al. | |
| 5,477,249 A | * | 12/1995 | Hotomi | 347/55 X |
| 5,510,819 A | | 4/1996 | Fujimoto et al. | |
| 5,530,465 A | | 6/1996 | Hasegawa et al. | |
| 5,617,127 A | | 4/1997 | Takeuchi et al. | |
| 5,657,062 A | * | 8/1997 | Shiraishi et al. | 347/55 |
| 5,736,993 A | * | 4/1998 | Regimbal et al. | 347/70 X |
| 5,828,393 A | | 10/1998 | Hotomi | |
| 5,877,789 A | * | 3/1999 | Reinten | 347/70 X |
| 5,877,790 A | * | 3/1999 | Hagiwara et al. | 347/55 |
| 5,923,346 A | * | 7/1999 | Mills et al. | 347/55 |
| 5,975,684 A | * | 11/1999 | Suetsugu et al. | 347/55 |
| 5,988,795 A | * | 11/1999 | Suetsugu et al. | 347/55 |

FOREIGN PATENT DOCUMENTS

| | | | |
|---|---|---|---|
| EP | 0584823 A1 | | 3/1994 |
| EP | 0709200 A1 | | 5/1996 |
| JP | 60046257 | * | 3/1985 |
| JP | 6 22 40559 | * | 10/1987 |
| JP | 03193455 | | 8/1991 |
| JP | 04263951 | | 9/1992 |
| JP | 04329145 | | 11/1992 |
| JP | 04338548 | | 11/1992 |
| JP | 05124187 | | 5/1993 |
| JP | 05261920 | | 10/1993 |
| JP | 08132621 | | 5/1996 |
| JP | 9-221393 | * | 8/1997 |

* cited by examiner

*Primary Examiner*—Benjamin R. Fuller
*Assistant Examiner*—C. Dickens
(74) *Attorney, Agent, or Firm*—Smith, Gambrell & Russell LLP

(57) ABSTRACT

An ink jet recording apparatus is disclosed, which apparatus has a pressure chamber that holds an ink liquid, and a nozzle communicating with the pressure chamber for discharging the ink liquid when pressure is applied to the pressure chamber. The pressure chamber has a diaphragm disposed therein. A piezoelectric element made of a monocrystalline or polycrystalline piezoelectric member highly oriented along a polarization axis showing perovskite structure, and mainly composed of lead zirconate titanate or barium titanate, is used to vibrate the diaphragm. When a specified voltage is applied to the piezoelectric element, it causes the ink liquid in the pressure chamber to be discharged into a recording medium at the front side of the nozzle.

5 Claims, 9 Drawing Sheets

INK JET RECORDING APPARATUS INCLUDING A PRESSURE CHAMBER AND PRESSURE APPLYING MEANS

CONTINUING APPLICATION DATA

This application is a continuation of U.S. Ser. No. 08/960,342 having a filing date of Oct. 29, 1997 and which is incorporated herein by reference in its entirety.

BACKGROUND OF THE INVENTION

1. Field of the Invention

The present invention relates to an ink jet recording apparatus used in a printer or the like for drawing characters and patterns by discharging liquid such as ink from tiny nozzles, and forming a liquid pattern on recording paper or sheet, and its manufacturing method.

2. Related Art of the Invention

Recently, as a printing device of a personal computer, the printer using an ink jet recording apparatus is widely used owing to its ease of handling, excellent printing performance, and low cost. The ink jet recording apparatus is available in various types, including a type of generating foams in ink by heat energy, and discharging ink drops by the pressure wave by the foams, a type of sucking and discharging ink drops by electrostatic power, and a type of making use of pressure wave by oscillator such as piezo element.

Generally, a type using a piezo element is composed of, for example, an ink feed chamber communicating with an ink nozzle, a pressure chamber communicating with this ink feed chamber, and a diaphragm combined with the piezo element, provided in this pressure chamber. Conventionally, the ink discharge direction and the vibrating direction of the piezo element were the same. In such constitution, when a specified voltage is applied to the piezo element, the piezo element is expanded or contracted, and a drum-like vibration occurs between the piezo element and diaphragm, and the ink in the pressure chamber is compressed, so that the ink liquid drops are discharged from the ink nozzle.

Incidentally, the work load W of the piezo element is $W\ E_p \cdot d_{31}^2\ (V/t)^2 \upsilon_p$, (where $E_p$: Young's modulus of piezo element, $d_{31}$: piezoelectric constant of the piezo element, V: voltage applied to the piezo element, t: thickness of the piezo element, and $\upsilon_p$: volume of the piezo element), and as the nozzle density is raised (the width of the pressure chamber is narrowed), the value of $\upsilon_p$ becomes smaller. Therefore, to obtain a work load necessary for discharging the ink, it is necessary to reduce the thickness of the piezo element, and heighten the withstand voltage of the piezo element. However, the piezo element used in the conventional ink jet head was a thick film or bulk, and it was difficult to achieve both thin film of piezo element and high withstand voltage. Hence, when the volume of the piezo element is decreased, the displacement of the diaphragm due to the piezo element becomes smaller, and sufficient discharge force is not obtained. On the other hand, if it is attempted to increase the displacement by increasing the work load W, it is difficult to realize small multi-nozzle head, high density of multi-nozzle or long length of the head, and it was difficult to achieve both small size of head and high recording speed. More specifically, in the conventional piezo element of thick film or bulk, the limit of the nozzle density was 2 to 3 nozzles/mm.

Accordingly, to solve the problems, for example, as disclosed in Japanese Patent Application No. 6-273650, the diaphragm is designed to vibrate in a direction vertical to the vibrating direction of the piezo element, and a small vibration caused by the piezo element is amplified to a large vibration, so that the displacement is increase in a same size, or in other proposal, a counter electrode is provided at a position opposite to the ink nozzle, a specified high voltage, for example, about 1.5 kV is applied between the counter electrode and the ink in the pressure chamber, and the ink is expanded to the counter electrode side (that is, the sheet or recording medium side) by its electrostatic power, so that the ink may be discharged by applying on a small pressure.

In such conventional ink jet recording apparatus, however, while a voltage is applied to the counter electrode so that the ink may be easily discharged by a small pressure, the ink is advanced to the leading end of the nozzle, and the ink droops from the leading end of the ink nozzle. To prevent ink drooping, alternatively, when the leading end of the nozzle is composed of a metal member (see FIG. 2(*a*); detail described later), the ink injecting speed is lowered, or to the contrary, when the leading end of the nozzle is composed of an insulator for increasing the ink injecting speed (see FIG. 2(*b*); detail described later), the ink droops, and owing to these contradictory problems, it was hard to increase the nozzle density, and in the case of multi-nozzle head by downsizing, crosstalk between nozzles occurs.

SUMMARY OF THE INVENTION

In consideration of the problems of such conventional liquid drop discharge device, it is an object of the invention to present an ink jet recording apparatus capable of preventing drooping of the ink from the leading end of the ink nozzle, increasing the nozzle density, and suppress the crosstalk between nozzles.

An ink jet recording apparatus of the claim 1 comprises a pressure chamber for accommodating an ink liquid, a nozzle communicating with this pressure chamber for discharging said ink liquid, and pressure applying means for applying a pressure to said pressure chamber, wherein said pressure applying means includes a diaphragm formed in said pressure chamber, and a piezoelectric element made of a monocrystalline or polycrystalline piezoelectric member highly oriented along a polarization axis showing perovskite structure, mainly composed of lead zirconate titanate or barium titanate, for vibrating the diaphragm, and a specified voltage is applied at least to said piezoelectric element when discharging said ink liquid into a recording medium disposed at the front side of said nozzle.

An ink jet recording apparatus of claim 3 comprises a pressure chamber for accommodating an ink liquid, a nozzle communicating with this pressure chamber for discharging said ink liquid, and pressure applying means for applying a pressure to said pressure chamber, wherein said pressure applying means includes a diaphragm formed in said pressure chamber, and a piezoelectric element made of a piezoelectric member such as $LiNbO_3$ or $LiTaO_3$, for vibrating the diaphragm, and a specified voltage is applied at least to said piezoelectric element when discharging said ink liquid into a recording medium disposed at the front side of said nozzle.

An ink jet recording apparatus of claim 4 comprises a first pressure chamber for accommodating an ink liquid, first pressure applying means for applying a pressure to this first pressure chamber, plural second pressure chambers communicating with said first pressure chamber having nozzles for discharging said ink liquid individually, and second pressure applying means for applying a pressure to each one of said plural second pressure chambers, wherein discharge and stopping of discharge of said ink liquid into a recording medium disposed at the front side of said nozzle are controlled by adjusting the applied pressure to said first pressure chamber by said first pressure applying means and the applied pressure to said second pressure chambers by said second pressure applying means.

As constituted herein, by independently controlling application of pressure by two pressure applying means, swelling of the ink liquid at the nozzle is uniform. Or if the fluctuations of the applied pressure by the pressure applying means are large, the effects are small. As a result, it is easy to realize higher density of nozzle heads, multiple nozzles, and smaller size.

An ink jet recording apparatus of claim 8 comprises an ink liquid chamber for accommodating an ink liquid, a nozzle communicating with this ink liquid chamber for discharging said ink liquid, and pressure wave generating means for injecting a pressure wave to said ink liquid chamber, wherein said pressure wave generating means includes a diaphragm formed in said ink liquid chamber, and a piezoelectric element for vibrating the diaphragm, and a specified high frequency voltage is applied at least to said piezoelectric element when discharging said ink liquid into a recording medium disposed at the front side of said nozzle.

In this constitution, the voltage applied to the piezoelectric element can be lowered, so that the nozzle head may be reduced in size.

The invention as set forth in claim 11 relates to a manufacturing method of an ink jet recording apparatus characterized by forming an individual electrode on a MgO substrate, forming a monocrystalline layer or polycrystalline layer having an orientation property showing perovskite structure, mainly composed of lead titanate zirconate or barium titanate, on this individual electrode, forming a common electrode on this monocrystalline layer or polycrystalline layer, forming a diaphragm made of a material comprising Ni, Cr, or zirconia on this common electrode, forming a pressure chamber for accommodating an ink liquid on this diaphragm, and removing the MgO substrate by etching, thereby fabricating pressure applying means for applying a pressure to the pressure chamber.

Such process is a manufacturing process of semiconductor, and hence higher density of nozzle heads, multiple nozzles, and longer size may be realized.

A manufacturing method of ink jet recording apparatus of claim 12 is characterized by forming a diaphragm on a specified surface of a pressure chamber for accommodating an ink liquid, integrally with said pressure chamber by an Si member, forming a common electrode on said diaphragm, coupling directly $SiO_2$ formed on this common electrode with $LiNbO_3$ or $LiTaO_3$, and forming an individual electrode further on this $LiNbO_3$ or $LiTaO_3$, thereby fabricating pressure applying means for applying a pressure to said pressure chamber.

Thus, by directly coupling the $SiO_2$ formed on the common electrode with $LiNbO_3$ or $LiTaO_3$, the piezoelectric effect is enhanced.

REFERENCE NUMERALS

Figure 1:
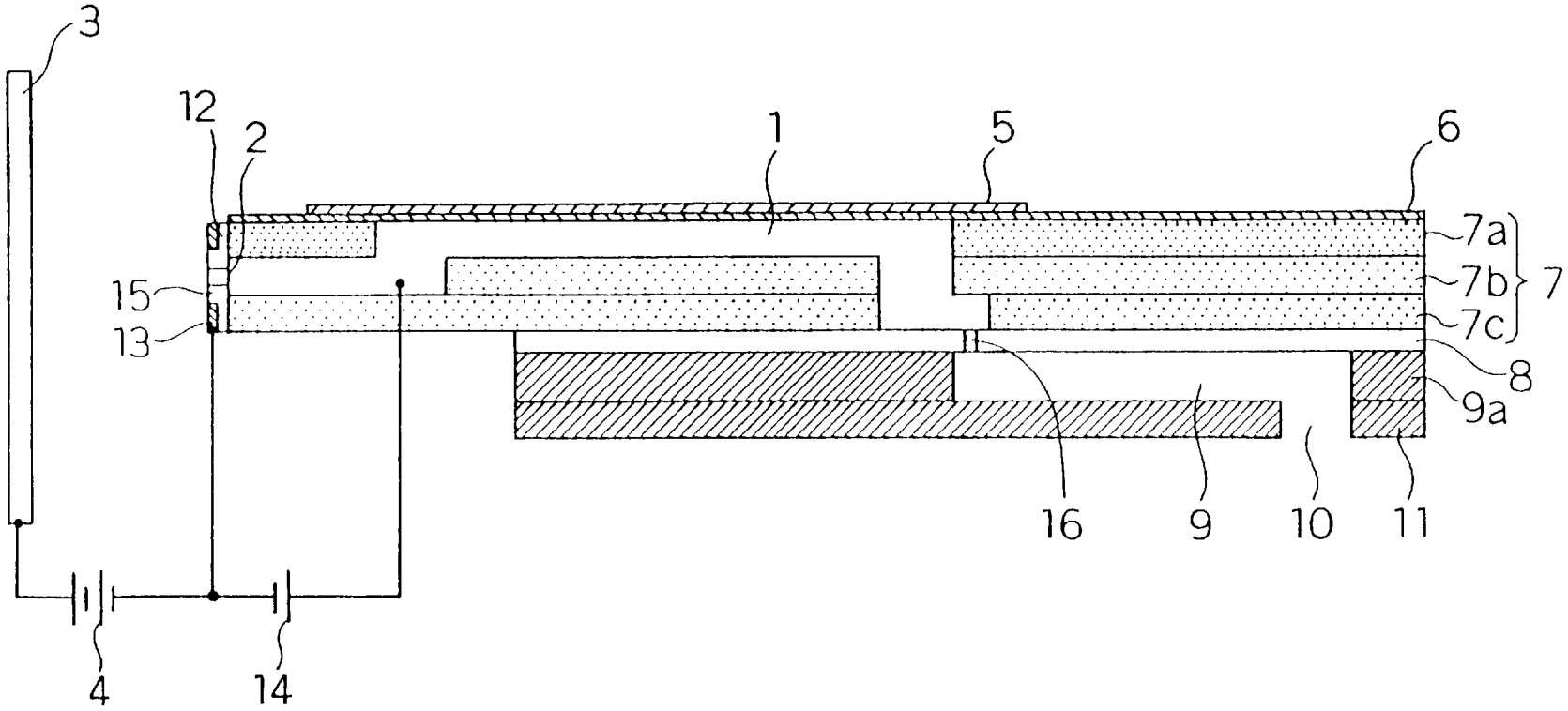
FIG. 1 is a sectional view of a nozzle head in an ink jet recording apparatus in a first embodiment of the invention.

1 Pressure chamber
2 Nozzle
3 Counter electrode
5 Piezoelectric element
6 Diaphragm
13 Control electrode
70 Water repellent film
903 Common electrode
906 Individual electrode
1001 MgO substrate
1101 Photosensitive glass
1301 Meniscus-generating piezo element (common piezo element)
1302 Ink injecting and stopping piezo element (individual piezo element)
1401 Common diaphragm
1402 individual diaphragm
1508 Pressure wave
1605 Recess

Preferred Embodiments of the Invention

Referring now to the drawings, embodiments of the invention are described below.

(First Embodiment)

FIG. 1 is a sectional view of a nozzle head in an ink jet recording apparatus in a first embodiment of the invention.

FIG. 1, a nozzle head of the embodiment is composed of a nozzle 2 for discharging ink, a pressure chamber 1 communicating with this nozzle 2 for accommodating the ink, a common liquid chamber 9 for feeding the ink into the pressure chamber 1 through a tiny hole 16, a piezoelectric element 5 for applying a pressure to the pressure chamber 1, and diaphragm 6 vibrated by the piezoelectric element 5. Incidentally, FIG. 1 is a sectional view, in which a plurality of pressure chambers 1 separated by partition are arranged in a direction vertical to this section, and therefore, the nozzles 2 are arranged in the same number as the pressure chambers 1. The common liquid chamber 9 is one chamber provided in all of the plurality of these pressure chambers 1. The piezoelectric element 5 and diaphragm 6 compose pressure applying means.

The pressure chamber 1 is composed of a pressure chamber structure 7 in a three-layer structure made of three layers of photosensitive glass 7*a*, 7*b*, 7*c*, a nickel-made diaphragm 6 formed on the photosensitive glass 7*a*, and a stainless steel feed side nozzle plate 8 having the tiny hole 16 for passing the ink into the pressure chamber 1. The nozzle 2 is composed of a discharge nozzle plate 12 forming a control electrode 13 in an insulating member 15 at a position remote from the hole of the nozzle 2 by a specified distance in the radial direction, an end of photosensitive glass 7*a*, an end of photosensitive glass 7*c*, and others, and the common liquid chamber 9 is comprised of the feed side nozzle plate 8, common liquid chamber structural plate 9*a*, and ink feed port flat plate 11 having an ink feed port 10. Herein, the common liquid chamber structural plate 9*a* and ink feed port flat plate 11 are made of stainless steel. The piezoelectric element 5 is formed on the diaphragm 6, and although not shown in the drawing, the piezoelectric element 5 is formed of one electrode of Au layer, piezoelectric member of PZT layer, and other electrode of Pt layer.

At a position confronting the nozzle 2 of the nozzle head, a counter electrode 3 is provided for the ease of discharge of ink, and a voltage source 4 for applying a voltage between the counter electrode 3 and the ink in the pressure chamber 1 is connected, and a voltage source 14 for applying a control voltage between the control electrode 13 of the nozzle 2 and the ink in the pressure chamber 1 is also connected.

In this first embodiment, the operation of the nozzle head is described below while referring to the drawings.

Figure 2A:
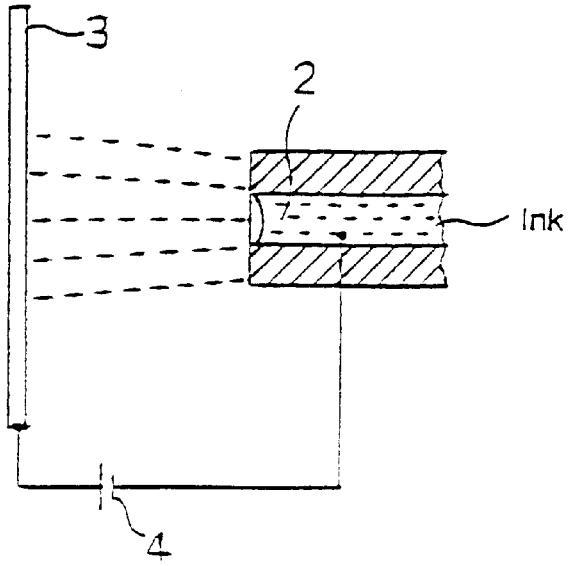
Fig. 2(a) PRIOR ART
FIGS. 2(*a*) and (*b*) show the state of electric field distribution in conventional nozzle, and (*c*) shows the state of electric field distribution in the nozzle of the first embodiment.
Figure 2B:
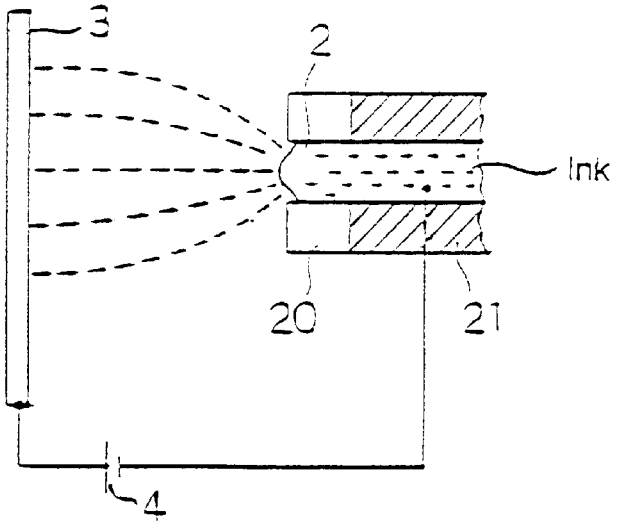
Fig. 2(b) PRIOR ART
Figure 2C:
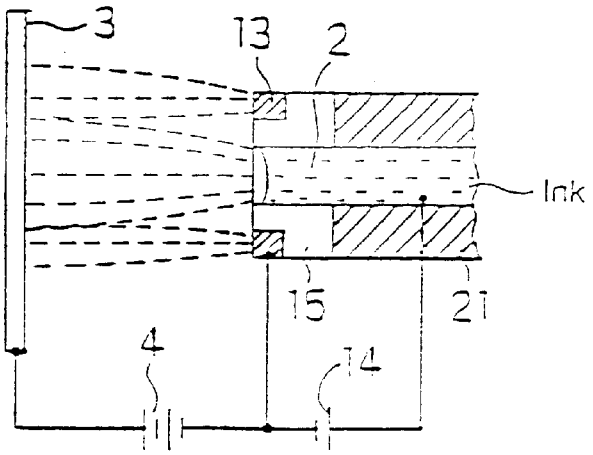

First, FIG. 2(*a*) shows a prior art in which the leading end of the nozzle 2 is entirely made of metal (conductor). When a voltage is applied between the nozzle 2 and the counter electrode 3 from the voltage source 4, the electric field distribution is almost parallel, and the electrostatic attraction to the ink is small, and the ink is swollen less to the counter electrode 3 side, and the ink hardly droops from the leading end of the nozzle 2. In this case, however, since the electrostatic attraction is small, the ink injecting speed is slow.

FIG. 2(*b*) shows a prior art in which the leading end of the nozzle 2 is completely covered with an insulator 20. When a voltage is applied between the nozzle 2 and the counter electrode 3 from the voltage source 4, the electric field is concentrated on the ink at the leading end of the nozzle 2, and the electrostatic attraction to the ink is large, and the ink injecting speed is increased. In this case however, contrary to the above case, since the force of attracting the ink to the counter electrode 3 side is large, the ink is largely swollen to the counter electrode 3 side, so that ink drooping occurs at the leading end of the nozzle 2.

On the other hand, FIG. 2(*c*) shows the nozzle in this embodiment, which presents an intermediate action of the two prior arts above. Since an insulator 15 is present between the control electrode 13 and the ink at the end of the nozzle 2, when a voltage is applied between the counter electrode 3 and the ink from the voltage source 4, concentration of the electric field is dispersed to the control electrode 13 side and the ink side, and the concentration of electric field on the ink is not so significant as in the case of FIG. 2(*b*), but is not so small as in the case of FIG. 2(*a*). As a result, the ink injecting speed is somewhat increased, while drooping of the ink can be suppressed.

Moreover, in the constitution of the invention, since an inverse voltage smaller than the voltage of the voltage source 4 is applied between the ink and the control electrode 13 from the voltage source 14, the meniscus formed by voltage application of the counter electrode 3 can be held as it is on the way of the nozzle 2, so that ink drooping can be prevented. In this case, by adjusting the region of the control electrode 13 and the region of the insulator 15, or adjusting the voltage of the voltage source 14, the degree of concentration of electric field on the ink, that is, the ink injecting speed and the ink holding force at the nozzle 2 can be controlled, so that optimum conditions can be selected.

Figure 3:
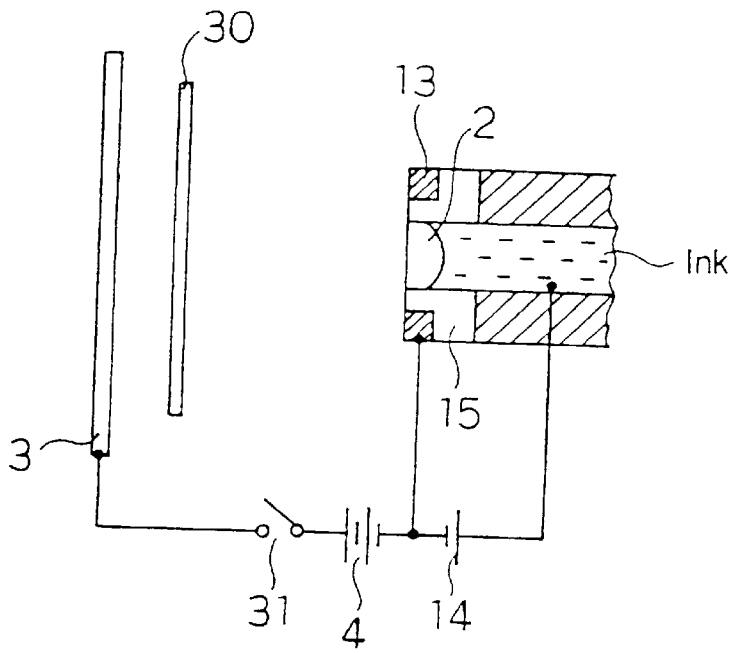
FIG. 3 is a diagram for explaining the state of the ink in the first embodiment.

FIG. 3 shows a state in which voltage is not applied to the counter electrode 3 in this embodiment (the switch 31 is off), and only a voltage is applied between the ink and control electrode 13. In this case, the ink is not swollen by the counter electrode 3, and the end of the ink is held at an intermediate position of the nozzle 2 by the applied voltage, so that the ink does not droop from the leading end of the nozzle.

Figure 4:
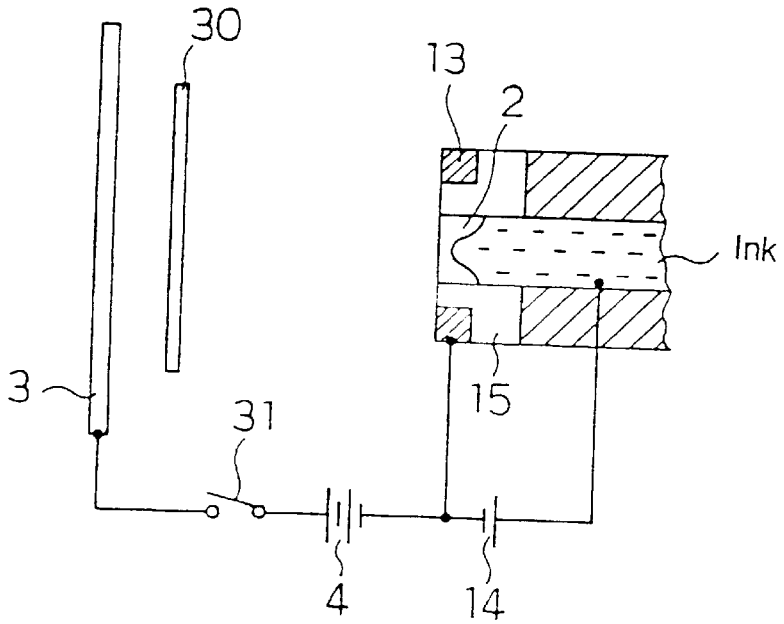
FIG. 4 is a diagram for explaining the state of the ink in the first embodiment.
Figure 5:
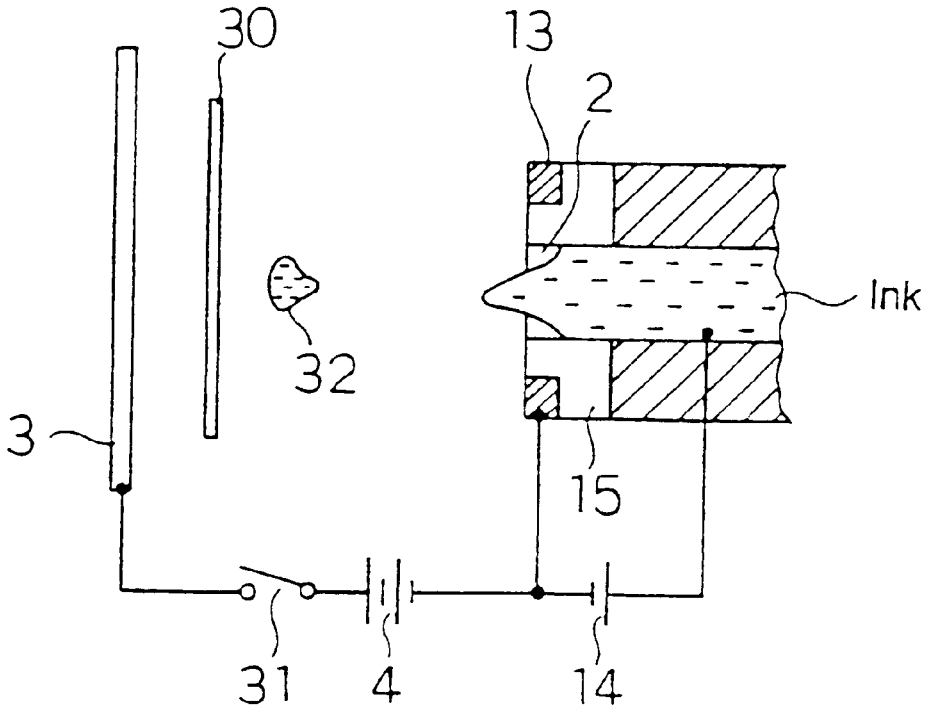
FIG. 5 is a diagram for explaining the state of the ink in the first embodiment.

Next, as shown in FIG. 4, by turning on the switch 31 to apply voltage between the counter electrode 3 and ink from the voltage source 4, the ink is attracted to the counter electrode 3 side by the electrostatic attraction, and a meniscus is formed, so as to be scattered easily from the nozzle 2. At this time, the voltage applied to the counter electrode 3 is a voltage of such an extent that the ink may not inject from the nozzle 2, or example, about 1.5 kV. Then, when a voltage is applied to the piezoelectric element and a pressure is thus applied to the pressure chamber (not shown), as shown in FIG. 5, ink liquid drops 32 pop out from the nozzle 2, and attracted by the electrostatic attraction of the counter electrode 3, and are adhered to a sheet 30 disposed on the way. In this case, operation is the same if pressure is first applied to the pressure chamber and then voltage is applied to the counter electrode 3. Later, stopping the pressure application and turning off the switch 31, when voltage application to the counter electrode 3 is stopped, it returns to the state in FIG. 3.

Figure 6:
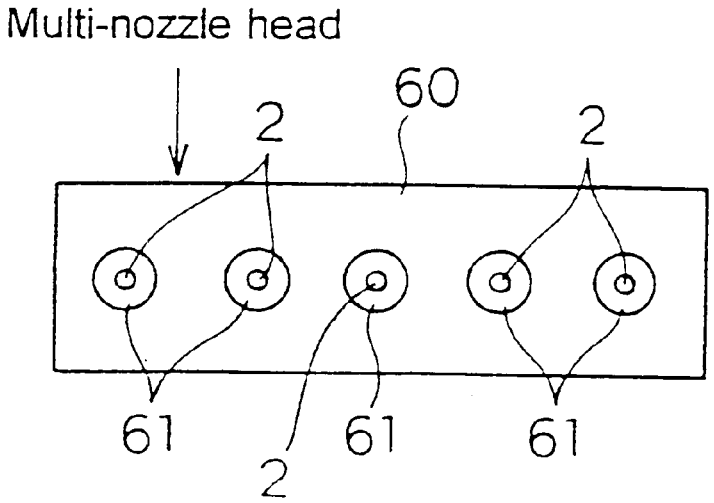
FIG. 6 is a diagram showing an example of multi-nozzle structure of the nozzle in the first embodiment.

Thus, according to the embodiment, by installing the control electrode 13 near the ink nozzle 2, the control electrode 13 and the ink in the nozzle 2 are isolated, and therefore the electric field is not concentrated too much on the ink, and the electrostatic attraction by the counter electrode 3 is not too small, and drooping of the ink from the nozzle 2 can be prevented, and the crosstalk between nozzles can be suppressed. Thus, since concentration of electric field between the counter electrode 3 and ink can be alleviated, crosstalk effects are smaller, and therefore, as shown in FIG. 6, for example, by composing the control electrode commonly by an electrode 60, arranging a plurality of nozzles 2 in a row, and surrounding the electrode 60 and the nozzles 2 by an insulator 61, multiple nozzles may be easily formed.

Figure 7B:
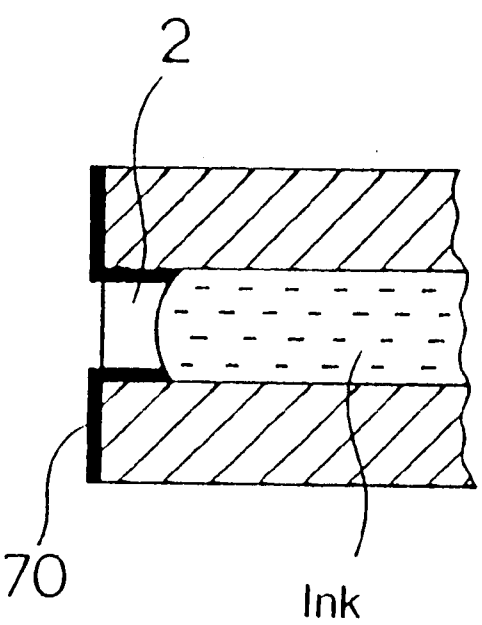
FIGS. 7(*a*), (*b*) show examples of forming water repellent film on the nozzle in the first embodiment.
Figure 7A:
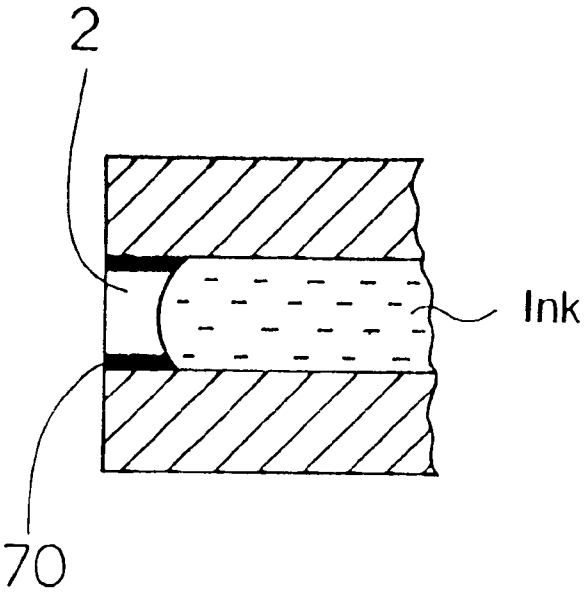

Herein, in this embodiment, drooping of the ink is prevented by holding the leading end of the ink at the nozzle 2 at its position by using the control electrode 13, and it is more effective to prevent drooping of ink by drawing back the ink to the pressure chamber side by using the following method. For example, as shown in FIG. 7(*a*) or FIG. 7(*b*), from the leading end portion of the nozzle 2 to a specified distance inside, or further, the leading end of the nozzle 2 may be covered with a water repellent film 70 having a water repellent property made of fluorine film. In this case, without control electrode, the ink is drawn back to the pressure chamber side as being repelled by the water repellent film 70, and drooping preventive effect is obtained. At this time, by combining with the control electrode 13, simultaneously with withdrawal of the ink, the ink can be held at the retreat position, and by the synergistic effects, the voltage applied to the control electrode 13 may be smaller, and the drop of applied voltage to the counter electrode 3 is smaller, so that the ink injecting speed can be increased while preventing drooping of the ink.

Figure 8:
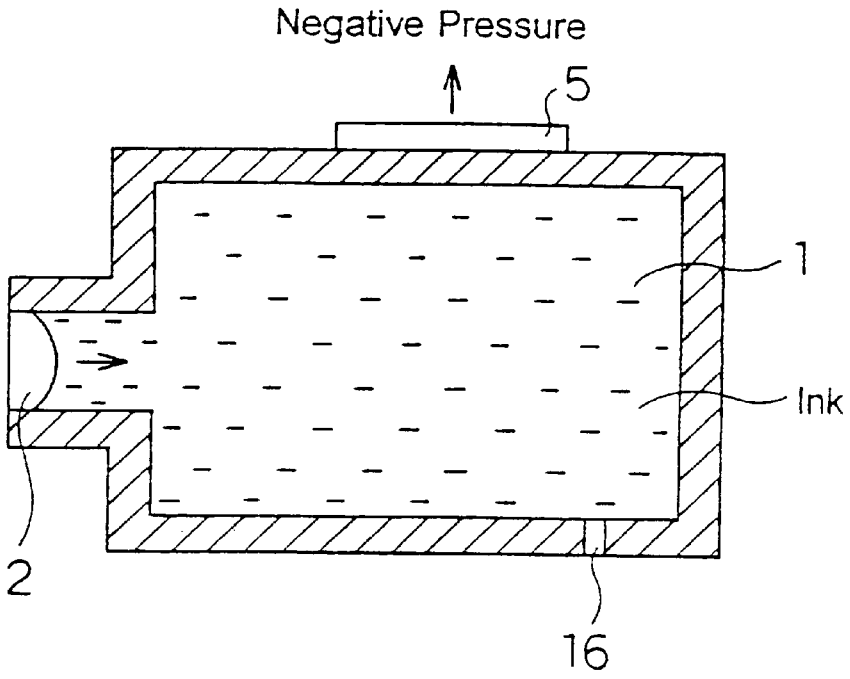
FIG. 8 is a diagram showing an example of realizing prevention of drooping of ink in the first embodiment.

FIG. 8 is a diagram showing other example for realizing withdrawal of ink at the nozzle. In the method shown in FIG. 8, by applying a negative pressure to the pressure chamber 1, the ink is drawn back to the pressure chamber 1 side through the nozzle 2 by atmospheric pressure. In this constitution, when a voltage is applied to the piezoelectric element 5 so that a negative pressure may be applied to the pressure chamber 1, the ink in the nozzle 2 is drawn back to the pressure chamber 1 side. At this time, the ink is going to flow also from the ink flow-in port 16 by negative pressure, but since the inside diameter of the nozzle 2 is larger than the inside diameter of the ink flow-in port 16, the flow-in from the ink flow-in port 16 is suppressed. Same as in the above case of using the water repellent film, the drooping preventive effect is obtained without using the control electrode 13 also in this case, but by using together with the control electrode 13, the synergistic effects of withdrawal of ink and holding at the withdrawal position are expected. Therefore, same as in the case of using the water repellent film, the voltage to be applied to the control electrode 13 may be small, and lowering of applied voltage to the counter electrode 3 is decreased, so that the ink injecting speed can be increased while preventing drooping of the ink.

In this embodiment, a voltage is applied to the control electrode 13, but not limited to this, the control electrode 13 may be kept at the same potential as the ink, or it may be electrically floating from the ink. In such cases, too, concentration of electric field between the counter electrode 3 and ink is lessened, and the same effects as mentioned above are obtained.

In the embodiment, the voltage applied to the control electrode 13 is reverse in polarity to the voltage applied to the counter electrode 3, but, not limited to this, voltages of same polarity may be applied.

The manufacturing method of the pressure chamber and piezoelectric element used in the embodiment is described below.

Figure 10:
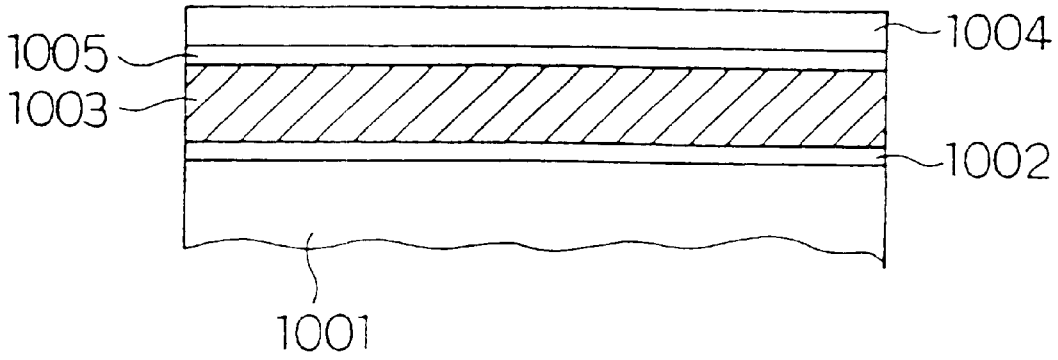
FIG. 10 is a diagram for explaining a manufacturing method of piezoelectric element and pressure chamber in the first embodiment.

FIG. 10 is a diagram for explaining the manufacturing method of the piezoelectric element and pressure chamber in the first embodiment.

Figure 11:
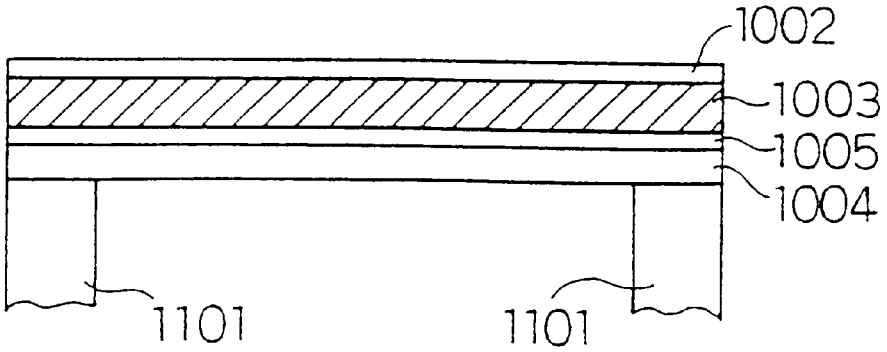
FIG. 11 is a sectional view showing a part of piezoelectric element and pressure chamber in the first embodiment.
Figure 12:
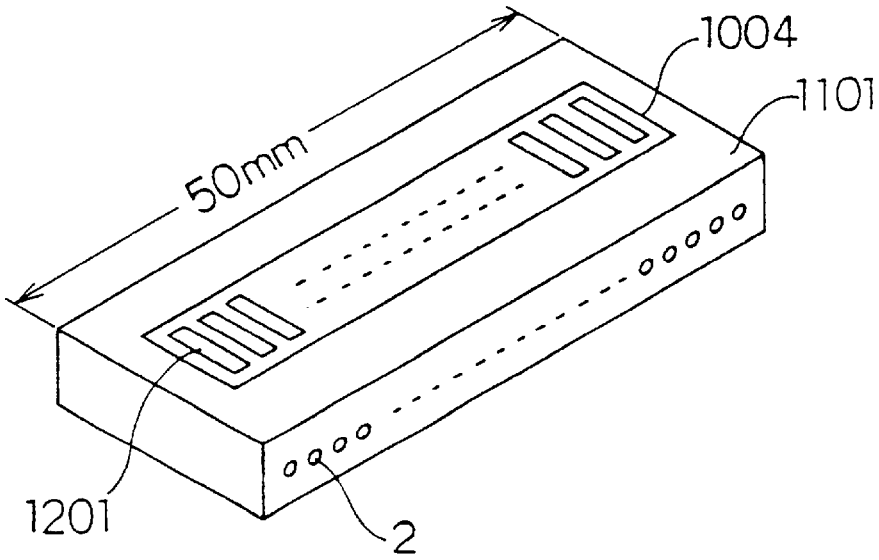
FIG. 12 is a perspective view showing an example of multi-nozzle head in the first embodiment.

In FIG. 10, first, a Pt layer as an individual electrode 1002 is formed on a substrate having a crystal structure of NaCl type, for example, MgO substrate 1001, and a PZT crystal oriented layer 1003 of piezoelectric material is formed on this individual electrode 1002. This PZT crystal oriented layer 1003 may be either PZT monocrystalline layer or a polycrystalline crystal orientation film aligned in the axis of polarization, showing perovskite structure, mainly composed of lead zirconate titanate or barium titanate. To obtain a sufficient discharge force, the film thickness of the layer should be 0.1 $\mu$m or more, and for a higher density, the film thickness of the layer is desired to be 10 $\mu$m or less. Therefore, the film thickness may be set in this range depending on the nozzle density. On this PZT crystal oriented layer 1003, moreover, an Au layer is formed as a common electrode 1005. On the common electrode 1005, consequently, a diaphragm 1004 made of material comprising Ni, Cr, or zirconia is formed by sputtering. On the diaphragm 1004, a structure of pressure chamber is formed by photosensitive glass 1101 (see FIG. 11), and finally the MgO substrate 1001 is removed by etching with phosphoric acid. FIG. 11 is a sectional view of the structure manufactured in this method. Conventionally, when the piezoelectric element and individual electrodes were manufactured by screen printing as disclosed, for example, in Japanese Laid-open Patent No. 6-040030, it was difficult to heighten the density, but as in this embodiment, by employing the semiconductor manufacturing process, higher density is realized, and, multiple nozzles and a longer head may be easily executed as shown in FIG. 12. The multi-nozzle head shown in FIG. 12 is a head formed in a nozzle density of 200 dpi in a width of 50 mm.

Therefore, the limit of nozzle density was 2 to 3 nozzles/mm formerly, but the nozzle density of 6 or 7 nozzles/mm may be easily realized in the invention. Incidentally, the MgO substrate may be replaced by other material as far as it has NaCl type crystal structure.

(Second Embodiment)

Figure 9:
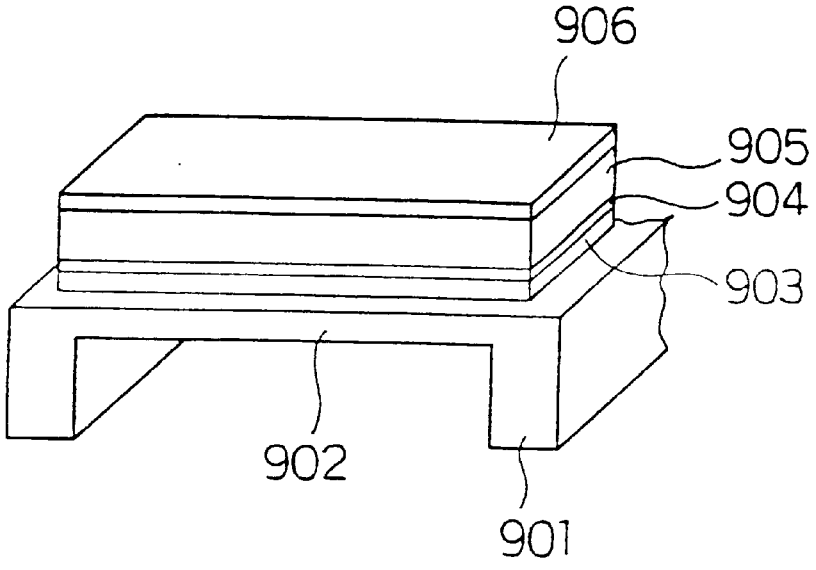
FIG. 9 is a block diagram showing a part of piezoelectric element and pressure chamber in a second embodiment of the invention.

FIG. 9 is a block diagram showing part of piezoelectric element and pressure chamber in a second embodiment of the invention.

In FIG. 9, first, a pressure chamber structure 901 and a diaphragm 902 are integrally fabricated by Si member, and a Pt or Au common electrode 903 is formed on the diaphragm 902 by sputtering. Then, $SiO_2$ 904 formed on the common electrode 903 and $LiNbO_3$ 905 of piezoelectric material are directly coupled. Moreover, an Au individual electrode 906 is formed on the $LiNbO_3$ 905. Herein, for example, the thickness of the diaphragm 902 is 10 $\mu$m, and the thickness of $SiO_2$ 904 is 3000 angstroms, and the piezoelectric effect is enhanced by direct coupling of $SiO_2$ 904 and $LiNbO_3$ 905 (see Shin-Etsu Chemical Technical Report of IEICE, US95-24, EMD95-20, CPM95-32, July 1995, pp. 31–38).

As the piezoelectric material, instead of $LiNbO_3$, $LiTaO_3$ may be also used.

(Third Embodiment)

Figure 13:
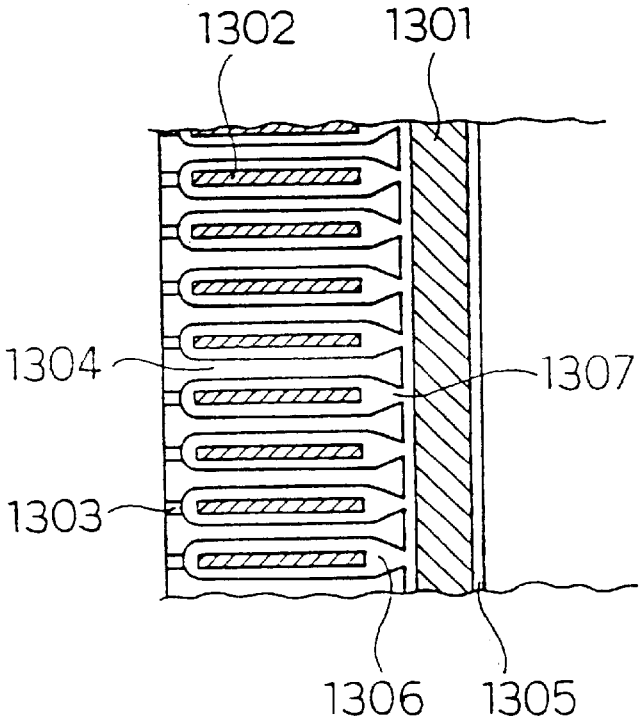
FIG. 13 is a plan view of a nozzle head in a third embodiment of the invention.

FIG. 13 is a plan view of a nozzle head in a third embodiment of the invention.

In this embodiment, as shown in FIG. 13, piezoelectric elements are formed in two stages in the ink injecting direction, and injection of the ink is controlled (hereinafter called two-stage piezo method). That is, the pressure chamber accommodating the ink is provided in a comb form, comprising a common liquid chamber 1305 as first pressure chamber, and plural individual liquid a chambers 1306 as second pressure chambers communicating with the common liquid chamber 1305, and the plural individual liquid chambers 1306 are separated by partition 1304. One end of each individual liquid chamber 1306 communicates with each nozzle (nozzle) 1303. The passage 1307 between the common liquid chamber 1305 and individual liquid chambers 1306 is reduced to a narrow size in order to suppress effects of on/off switching of other nozzles 1303, in particular, adjacent nozzles 1303.

Figure 14:
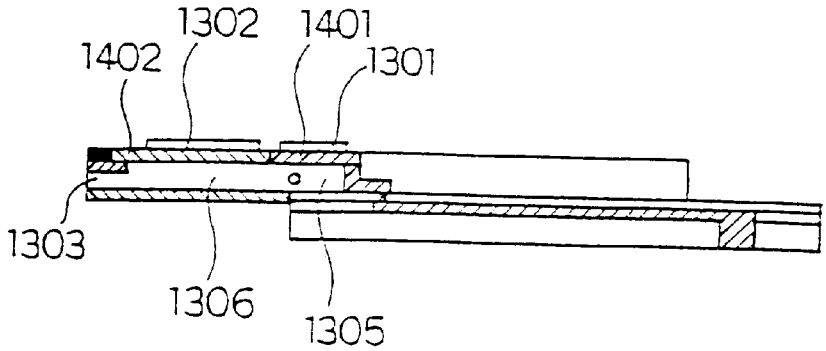
FIG. 14 is a sectional view of the nozzle head in the third embodiment.

Above the common liquid chamber 1305, a meniscus generating piezo element (hereinafter called common piezo element) 1301 for applying a pressure to the entire common liquid chamber is provided, and above the individual liquid chambers 1306, ink injecting and stopping piezo elements (hereinafter called individual piezo elements) 1302 for controlling ink injection are provided. As shown in FIG. 14, a common diaphragm 1401 is formed at the lower side of the common piezo element 1301, and individual diaphragms 1402 are formed at the lower side of the individual piezo elements 1302. Therefore, pressure application to the common liquid chamber 1305 and pressure application to the individual liquid chambers 1306 can be effected independently by the common piezo element 1301 and individual piezo elements 1302. Herein, the common piezo element 1301 and common diaphragm 1401 compose first pressure applying means, and the individual piezo elements 1302 and individual diaphragms 1402 compose second pressure applying means.

In the two-stage piezo method of thus constituted embodiment, the driving method is available in three manners.

(a) The applied pressure by the common piezo element 1301 is set high, and ink is discharged. At this time, pressure is not applied by the individual piezo element 1302, and the ink is discharged only by the common piezo element 1301. To stop the ink discharge, a negative pressure is applied by the individual piezo elements 1302, and the applied pressure of the common piezo element 1301 is weakened. This is called the pull-up method hereinafter.

(b) The applied pressure by the common piezo element 1301 is kept low, and when discharging the ink, pressure is applied by the individual piezo elements 1302, and the ink is discharged by the applied pressure of both common piezo element 1301 and individual piezo elements 1302. The ink discharge is stopped by cutting off pressure application by the individual piezo elements 1302. Therefore, while the applied pressure by the common piezo element 1301 is weak, the pressure is not strong enough to discharge the ink. This is called the bias method hereinafter.

(c) In an improved method of the bias method, it is the same when discharging the ink, that is, the applied pressure by the common piezo element 1301 is low, and when discharging the ink, pressure is applied by the individual piezo elements 1302, so that the ink is discharged by applied pressure of both common piezo element 1301 and individual piezo element 1302. When stopping the ink discharge, on the other hand, a negative pressure is applied by the individual piezo elements 1302. In this case, the applied pressure by the common piezo element 1301 is canceled for the portion of the negative pressure. This is called the improved bias method hereinafter.

By employing these driving methods, in the pull-up method of (a), meniscus is formed in each nozzle by the common piezo element 1301, and a uniform meniscus is formed, and dots are uniform. When discharging the ink, since the individual piezo elements 1302 are not used, the dots are uniform, being free from effects of fluctuations of the individual piezo elements 1302. Moreover, ink discharge control is achieved only by stopping the individual piezo elements 1302, it is sufficient with a small piezoelectric power, and the individual piezo elements 1302 may be reduced in size, so that a higher density is realized.

On the other hand, in the bias method of (b), since the applied pressure by the common piezo element 1301 creates a bias state, the required piezoelectric power of the individual piezo elements 1302 can be reduced by this effect. Therefore, the individual piezo elements 1302 can be reduced in size, so that a higher density is realized.

In the improved bias method of (c), the difference in applied pressure by the control of the individual piezo elements 1302 is large between discharge and stop, and it is free from effects if bias fluctuations of the common piezo element 1301 are significant.

Thus, according to the two-stage piezo system of the embodiment, a uniform meniscus may be easily formed, the required piezoelectric power of the individual piezo elements 1302 may be reduced, and large fluctuations can be ignored, so that a higher density is realized. Moreover, when maximum pressure is applied by both common piezo element 1301 and individual piezo elements 1302, powerful discharge is possible for head cleaning or servicing.

(Fourth Embodiment)

Figure 15:
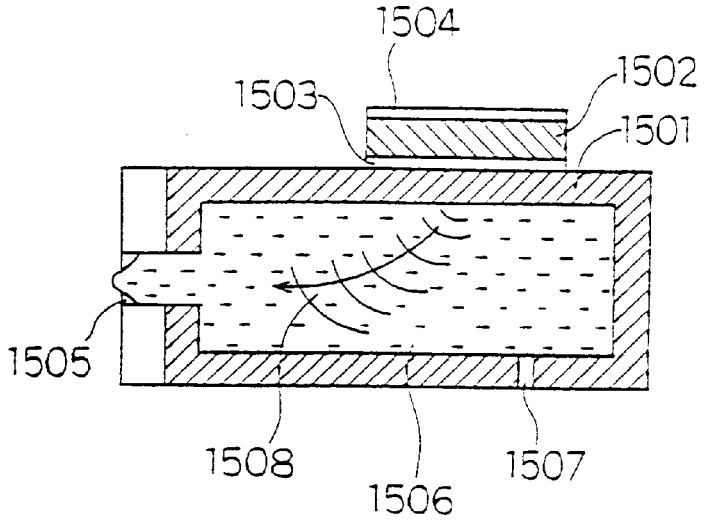
FIG. 15 is a sectional view of a nozzle head in a fourth embodiment of the invention.

FIG. 15 is a sectional view of a nozzle head in a fourth embodiment of the invention.

In FIG. 15, an individual liquid chamber 1506 for accommodating ink is formed of $S_i$ member including a diaphragm 1501, and the thickness of the portion of the diaphragm 1501 is, for example, 100 $\mu$m. On the diaphragm 1501, a common electrode 1503 as one of the electrodes of the piezoelectric element is formed of $A_u$, and PZT 1502 of piezoelectric element is formed on the common electrode 1503. Further on the PZT 1502, other electrode of individual electrode 1504 is formed of $A_u$. In the individual liquid chamber 1506, a nozzle 1505 as ink nozzle and an ink feed port 1507 for feeding ink are provided. The thickness of the PZT 1502 is, for example, also 100 $\mu$m.

As a feature of this embodiment, unlike the foregoing embodiments for applying pressure to the pressure chamber and injecting the ink by this pressure, an AC voltage of high frequency, for example, 2 to 3 volts, 10 MHz, is applied to the PZT 1502 to vibrate the diaphragm 1501, and a pressure wave 1508 is produced, and this pressure wave 1508 propagates through the ink in the individual liquid chamber 1506 in the direction toward the nozzle 1505, and the ink is discharged by the impact of the propagating pressure wave 1508. Therefore, according to the constitution of the embodiment, by applying voltage of only few volts, the ink can be discharged from the nozzle 1505. In this case, the propagating direction of the pressure wave 1508 should be designed to run in the direction of the nozzle 1505 as far as possible.

(Fifth Embodiment)

Figure 16:
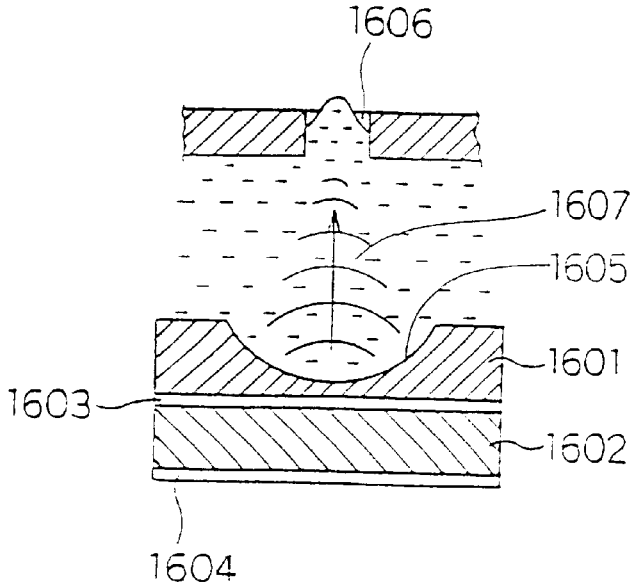
FIG. 16 is a sectional view of a nozzle head in a fifth embodiment of the invention.

FIG. 16 is a sectional view of a nozzle head in a fifth embodiment of the invention.

This embodiment also makes use of the pressure wave same as in the fourth embodiment. In FIG. 16, a recess 1605 is formed in a diaphragm 1601 made of Si member of 100 $\mu$m in thickness, in a portion confronting a nozzle 1606, and at the back side of the Si member forming the recess 1605, a piezoelectric element of PZT 1602 is provided. The shape of the recess 1605 is effective herein if the vicinity of the nozzle 1606 is at the focal position. On both surfaces of the PZT 1602, a common electrode 1603 and individual electrode 1604 for applying voltage are formed. In this embodiment, same as in the fourth embodiment, a high frequency voltage is applied to the PZT 1602 to vibrate the diaphragm 1601, and the ink is discharged from the nozzle 1606 by the impact of the generated pressure wave 1607.

In the embodiment, as a high frequency voltage, for example, when an AC voltage of 1 volt, 10 MHz is applied to the PZT 1602, the diaphragm 1601 vibrates to generate a pressure wave 1607. Since the recess 1605 is formed in the diaphragm 1601, the pressure wave 1607 converges near the nozzle 1606 by the action of the recess 1605, and the discharge force by the pressure wave 1607 is increased, so that the ink is discharged more effectively. Hence the ink can be discharged by a further smaller voltage than in the fourth embodiment.

In the fourth and fifth embodiments, the frequency of the high frequency voltage applied to the PZT is 10 MHz, but this is not limited as far as a pressure wave capable of injecting the ink at low voltage can be generated.

Also in the fourth and fifth embodiment, PZT is used as the piezoelectric element, but other piezoelectric materials such as $LiNbO_3$ and others as explained in the second embodiment may be also used.

As clear from the description herein, according to the invention, an individual electrode is formed on a substrate having NaCl type crystal structure, a monocrystalline layer or polycrystalline layer having an orientation property showing perovskite structure, mainly composed of lead zirconate titanate or barium titanate is formed on this individual electrode, a common electrode is formed on this monocrystalline layer or polycrystalline layer, a diaphragm is formed on this common electrode, a pressure chamber for accommodating an ink liquid is formed on the diaphragm, and the substrate is removed by etching, so that pressure applying means for applying pressure to the pressure chamber is fabricated, and therefore the nozzle density can be heightened, and crosstalk of nozzles can be suppressed.

Moreover, when a control electrode is disposed near the nozzle, ink drooping from the leading end of the ink nozzle can be prevented.

What is claimed is:

1. An ink jet recording apparatus, comprising:

a pressure chamber, for accommodating an ink liquid;

a nozzle, communicating with the pressure chamber for discharging the ink liquid; and pressure applying means, for applying a pressure to the pressure chamber, the pressure applying means comprising:

a diaphragm formed in the pressure chamber, and a piezoelectric element, for vibrating the diaphragm, comprised of:

(i) a polycrystalline piezoelectric member, which is highly oriented along a polarization axis, or (ii) a monocrystalline piezoelectric member, of perovskite structure, comprising lead zirconate titanate or barium titanate, wherein a predetermined voltage is applied at least to the piezoelectric element when discharging the ink liquid into a recording medium disposed at a front side of the nozzle.

2. The ink jet recording apparatus according to claim 1, wherein a film thickness of the piezoelectric member of the piezoelectric element is from 0.1 $\mu$m to 10 $\mu$m.

3. The ink jet recording apparatus according to claim 2, further comprising:

a counter electrode, disposed at a position confronting the nozzle;

a voltage source, for applying a predetermined voltage between the counter electrode and the ink liquid; and a control electrode disposed on a nozzle plate of the nozzle for changing an electric field distribution when the predetermined voltage is applied from the voltage source.

4. The ink jet recording apparatus according to claim 1, further comprising a counter electrode disposed at a position confronting the nozzle, a voltage source for applying a predetermined voltage between the counter electrode and the ink liquid, and a control electrode disposed on a nozzle plate of the nozzle for changing the electric field distribution when the predetermined voltage is applied from the voltage source.

5. A method of manufacturing the ink jet recording apparatus according to claim 1, comprising:

forming an individual electrode on a substrate having a crystal structure of NaCl type;

forming on the individual electrode either:

(i) a polycrystalline layer which is highly oriented along a polarization axis, or (ii) a monocrystalline layer of perovskite structure, comprised of lead zirconate titanate or barium titanate;

forming a common electrode on the polycrystalline or monocrystalline layer;

forming a diaphragm on the common electrode;

forming a pressure chamber for accommodating an ink liquid on the diaphragm; and removing the substrate, thereby fabricating a pressure applying means for applying a pressure to the pressure chamber.

* * * * *